United States Patent [19]

Mistyurik et al.

[11] Patent Number: 4,844,438

[45] Date of Patent: Jul. 4, 1989

[54] TAG STACKER AND STACKING METHOD

[75] Inventors: John D. Mistyurik; Bruce E. Taylor, both of Tipp City; Orville C. Huggins, Dayton, all of Ohio

[73] Assignee: Monarch Marking Systems, Inc., Dayton, Ohio

[21] Appl. No.: 136,305

[22] Filed: Dec. 22, 1987

[51] Int. Cl.[4] ..... B65H 29/44

[52] U.S. Cl. ..... 271/181; 271/212; 271/224

[58] Field of Search ..... 271/181, 212, 223, 224, 271/146, 177

[56] References Cited

U.S. PATENT DOCUMENTS 2,884,243 4/1959 Stobb ..... 271/178
3,148,879 9/1964 Kistner ..... 271/181 X
3,704,793 12/1972 Nicol ..... 271/178 X
4,474,366 10/1984 Reider ..... 271/181

FOREIGN PATENT DOCUMENTS 1047055 11/1966 United Kingdom ..... 271/181

*Primary Examiner*—Richard A. Schacher
*Attorney, Agent, or Firm*—Joseph J. Grass

[57] ABSTRACT

There is disclosed a tag stacker and tag stacking method for taking tags from an output device such as a printer and stacking them in a stack. Tags are inputted one-by-one into the stacker and are moved from a generally horizontal orientation to a generally vertical orientation in a stack. Tags are fed one-by-one into the stack in a hopper, the tags are tamped to settle them in the hopper and the stack is advanced by a conveyor as the stack builds. A side of the stack is guided by an adjustable side guide.

18 Claims, 8 Drawing Sheets

102
99
101
81
80
16

10
12
69
82
79
86
93
67
11
42
13
14
24

67
66
59
61
15
60
50
49
51
18
63
61
53
58
47
26
48
57
40
22
27
22
25
41
17
13
21
28
24
41
41
78
42
23
31
19

19

49
17
57
48
56
55
54
53
52
70
69
25
39
74
75
37
105
20
34
36
20
36
35
76
68
67
38
20
77
23
32
78
37
30
35
33
31
13

TAG STACKER AND STACKING METHOD

CROSS-REFERENCE TO RELATED APPLICATIONS

Reference is hereby made to copending application Ser. No. 907,263 filed Sept. 15, 1986 of Orville C. Huggins and John D. Mistyurik and application Ser. No. 817,329 filed Jan. 9, 1986 of Bruce E. Taylor, Orville C. Huggins and Augustus W. Griswold, now abandoned, and its continuation application Ser. No. 91,287 filed Aug. 24, 1987, all of said applications having been assigned to the present owner, Monarch Marking Systems, Inc., the assignee of the present invention.

BACKGROUND OF THE INVENTION

1. Field of the Invention

This invention relates to the field of method and apparatus for stacking tags.

2. Brief Description of the Prior Art in the United States

The following prior art publications are made of record: U.S. Pat. No. 3,874,650 granted Apr. 1, 1975 to Horst L. Steigerwald and Gilbert B. Clift, Jr.; U.S. Pat. No. 4,442,774 granted Apr. 17, 1984 to Frederick M. Pou and Richard L. Straub; and UK patent application No. 2,152,465A published Aug. 7, 1985 of Roman M. Golicz et al.

SUMMARY OF THE INVENTION

This invention relates to an improved tag stacker and stacking method for receiving tags one-by-one from a tag dispensing device such as a printer and for orienting the tags in an upright position in a stack.

It is a feature of the invention to provide improved method and apparatus involving receiving generally horizontal tags, feeding them to a vertically inclined position into an end of a stack, tamping the stack including the last tag received to promote settling of the tags in the stack, and feeding the tags when the stack builds.

It is also a feature of the invention to kick the trailing edge of the tag being added to the stack so that the tag moves from an acute angle with respect to the stack and flexes slightly until the tag is brought into parallel relationship with respect to the immediately adjacent tag.

It is a feature of the invention to continuously tamp the tag stack while tags are being added to the stack to allow space for entry of the incoming tag and to effect settling of the stack so that the edges of the tags at the top of the stack are generally aligned.

It is also a feature of the invention to provide for tamping of a tag stack, where tamping takes place between a continuously operating input conveyor and in intermittently operable output conveyor.

It is another feature of the invention to input tags to the end of an upright stack where the feeder then feeds a tag into the stack and continues the feeding engagement and action to a position above a floor of the stacker so that the last tag assuredly is fully inserted into the stack and wherein the tag is tamped to cause the last tag to settle down with its trailing edge supported by the floor.

It is a feature of the invention to provide a simple and improved tag stacker and method of stacking which forms a stack having tags of different lengths, such as regular length price marking tags and longer length header and/or trailer tags.

It is another feature of the invention to provide an improved side guide for the stack in conjunction with an oscillating tamper wherein the tags including an incoming tag cannot be caught between the tamper and the side guide.

Other features of the invention will be readily apparent from a reading of the following detailed description and from reference to the accompanying drawings.

DETAILED DESCRIPTION OF THE PREFERRED EMBODIMENT

Figure 1:
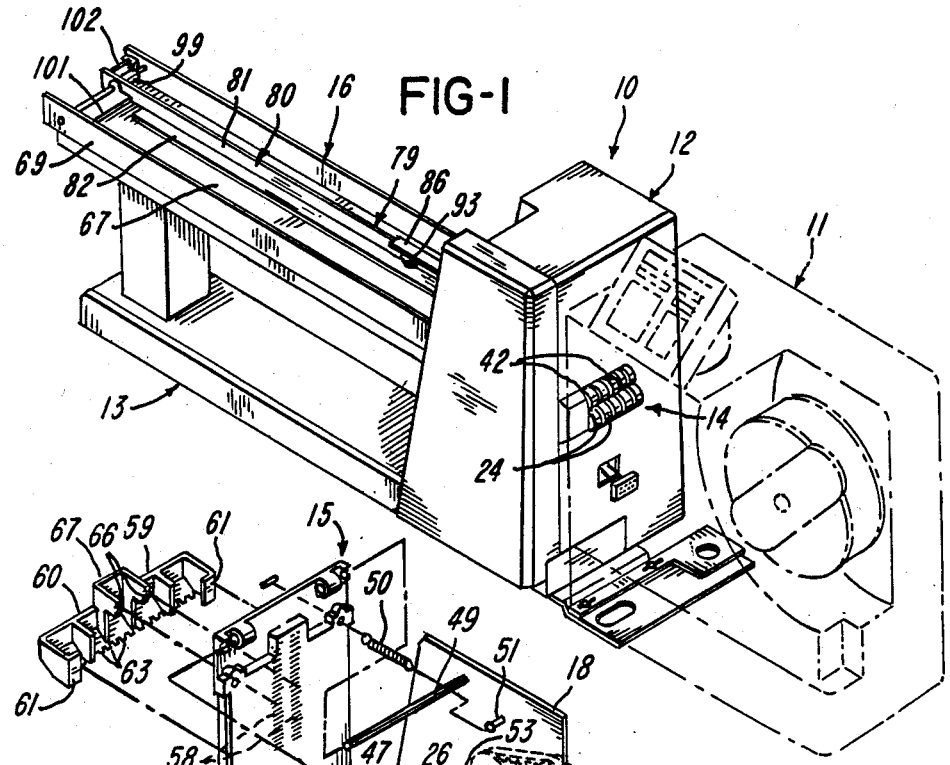
FIG. 1 is a perspective view of a tag stacker in accordance with the invention in solid lines and a printer shown in phantom lines.

With reference to FIG. 1, there is shown a tag stacker generally indicated at 10 shown to be coupled to a printer shown by phantom lines and generally indicated at 11. The printer 11 can be the printer shown and described in copending U.S. application Ser. No. 885,886 filed July 15, 1986. The stacker 10 includes a housing generally indicated at 12 mounted on a frame generally indicated at 13.

Figure 2:
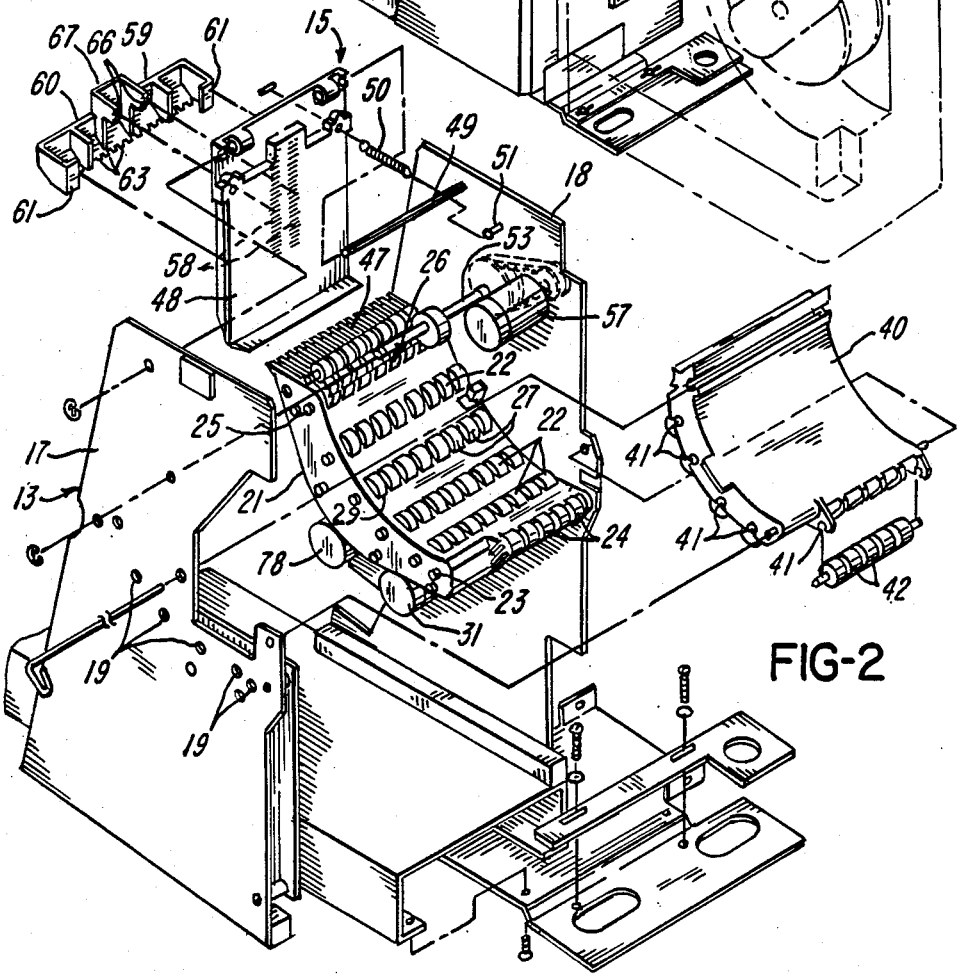
FIG. 2 is a fragmentary perspective view showing portions of an infeed or input conveyor and a tamping mechanism.
Figure 4:
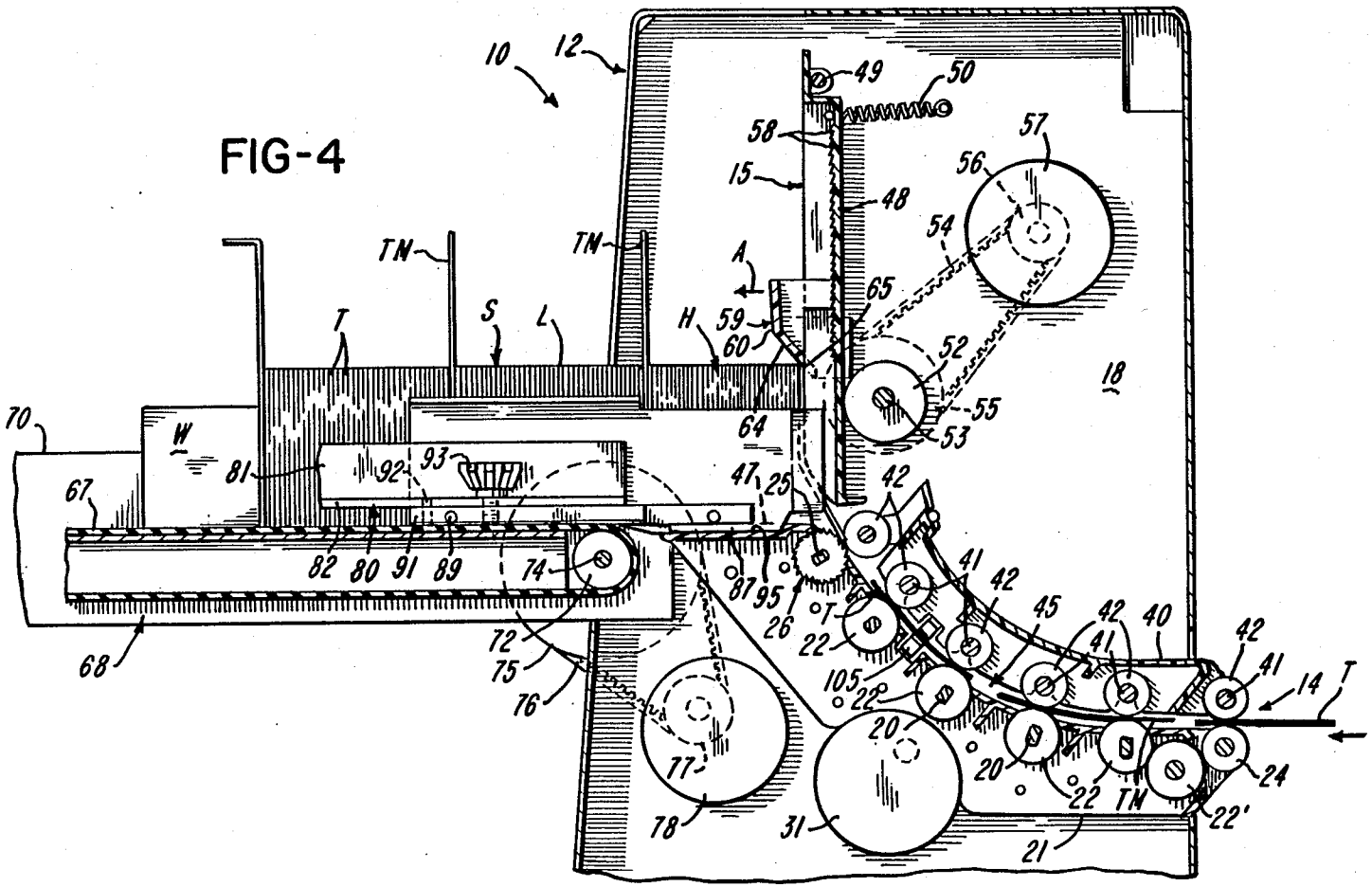
FIG. 4 is a vertical sectional view taken generally along line 4—4 of FIG. 3.
Figure 6:
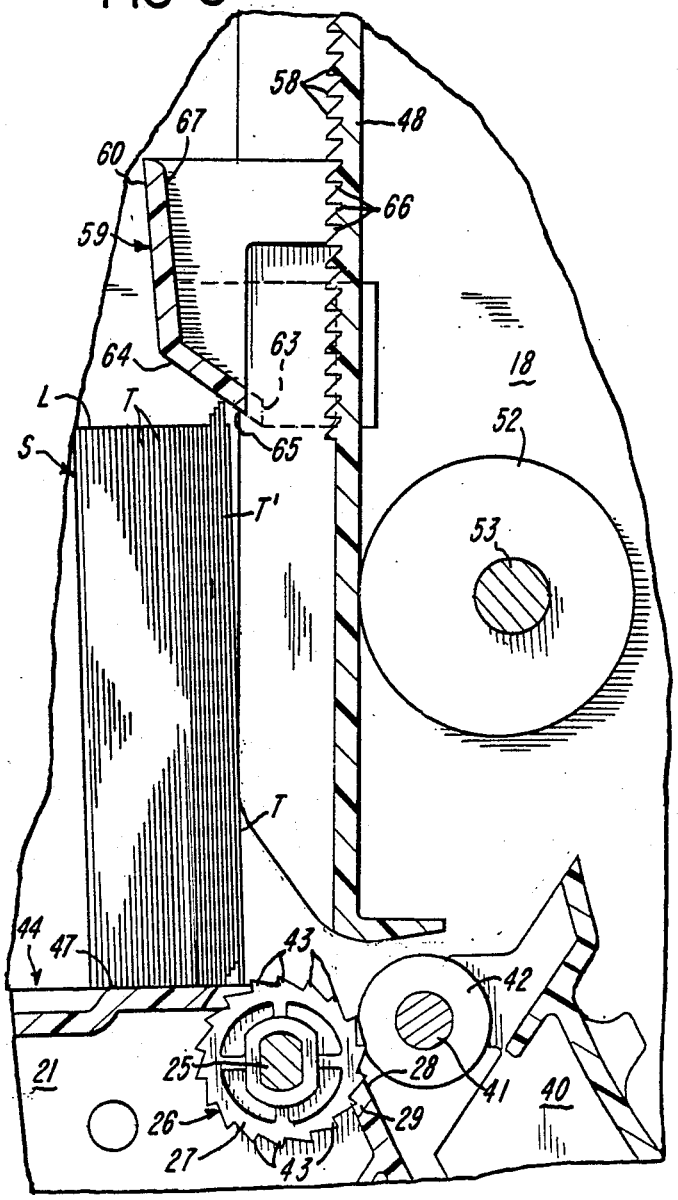
FIG. 6 is a view similar to FIG. 5, but showing the tamping mechanism and the last tag in different respective positions.
Figure 7:
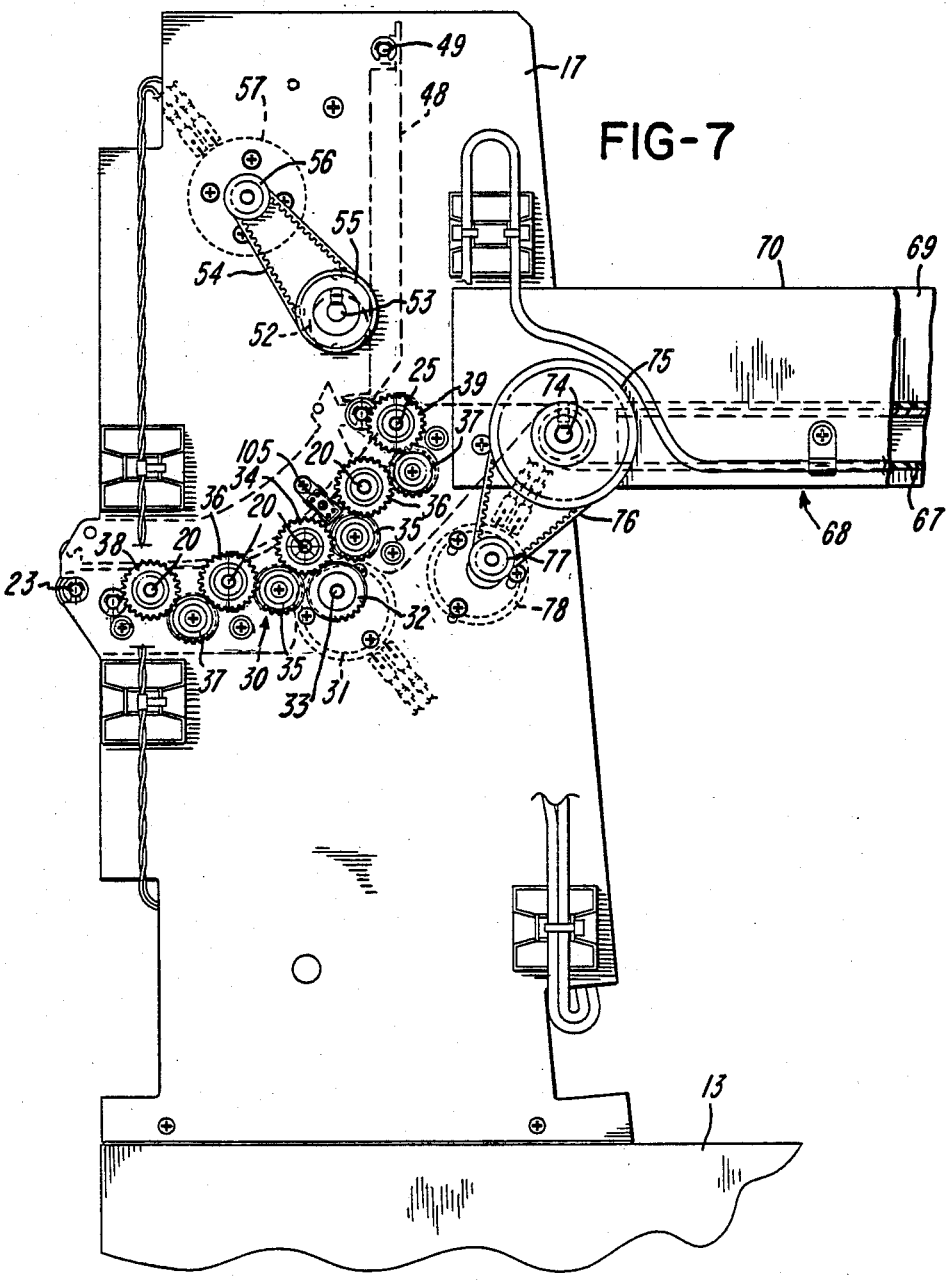
FIG. 7 is a sectional view taken generally along line 7—7 of FIG. 3.

With reference to FIG. 4, there is shown an infeed conveyor or feeding mechanism generally indicated at 14, a tamping mechanism generally indicated at 15, and an outfeed conveyor or feeding mechanism generally indicated at 16 (FIG. 1). With reference also to FIG. 2, the frame 13 is shown to include a pair of spaced frame plates 17 and 18. The plates 17 and 18 have aligned holes 19 for receiving shafts 20. The shafts 20 are received in a mounting member 21. A series of axially spaced rolls 22 are secured to each shaft 20. The rolls 22 are preferably non-deformable and rotate together with their respective shafts 20. The mounting member 21 also mounts a shaft 23 to which an idler drive roll 22' is mounted. The roll 22' is driven by one of the rolls 22 and drives the rolls 24. The mounting member 21 also mounts a shaft 25 to which a pusher or kicker roll 26 is mounted. The kicker roll 26 has spaced rolls 27 (best shown in FIGS. 5 and 6). The mounting member 21 has a contoured outer surface 28 having holes 29 through which the rolls 22 and 27 project. As best shown in FIG. 7, gearing generally indicated at 30 drivingly connects an electric motor 31 having a speed reducer, and the shafts 20 and 25. The gearing 30 includes a gear 32 on output shaft 33 of the motor 31. The gear 32 meshes with a gear 34 on one of the shafts 20. The gear 34 meshes with two idler gears 35 which mesh with respective gears 36. The gears 36 mesh with idler gears 37 which mesh respectively with a gear 38 on one of the shafts 20 and a gear 39 on the shaft 25. As all the drive gears 32, 34, 36, 37, 38 and 39 are preferably the same size, and as all the idler gears 35, 36 and 37 are the same size but are shown to be smaller than the drive gears, there is some commonality of parts. The electric motor 31 drives each of the shafts 20 and 25 to in turn drive the rolls 22 and 27.

A mounting member 40 mounts shafts 41 which in turn mount spaced idler rolls 42. The rolls 42 are preferably resilient to assure that the driven rolls 22 and 27 are properly backed-up. The resilience of the rolls 42 facilitates the feeding of tags of different thicknesses. The roll 26 is sized so that its peripheral speed is at least as great and preferably slightly greater than the peripheral speed of the rolls 22. This assures that tags T do not bunch and in particular obviates double feed of tags by the roll 26 and its back-up roll 42. The rolls 27 which comprise the roll 26 are shown especially well in FIGS. 5 and 6 to have equally peripherally spaced teeth 43. The teeth 43 of the rolls 27 are axially aligned. The teeth 43 cooperate with respective roll 42 to pinch the tag T in their nip. The teeth 43 have a pushing or kicking effect on the trailing edge TE of the tag T which is entering hopper 44.

As seen also with reference to FIG. 4, the tags T and TM are fed along a curved pathway generally indicated at 45. The tags T are of equal length and the tags TM are longer as shown. The tags T typically are price marking tags and the tags TM are marker tags which can be header tags, tailer tags, or the like which indicate the beginning and ending of a stack or related tags T.

Figure 5:
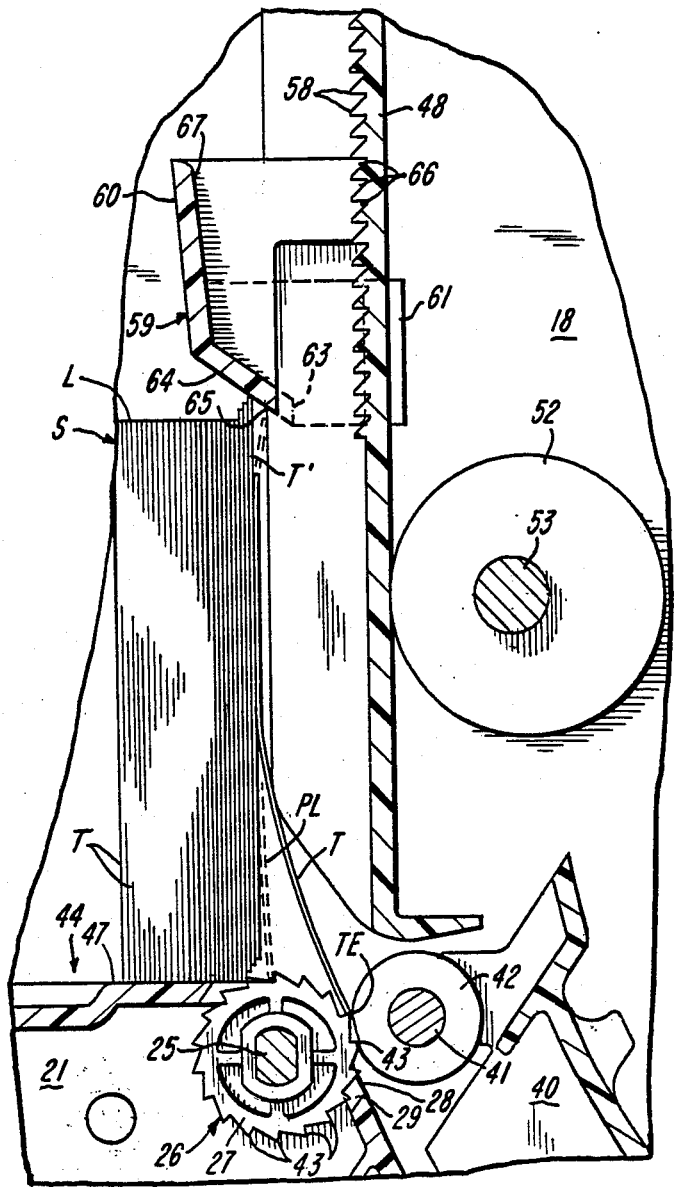
FIG. 5 is an enlarged diagrammatic view showing a tag being fed into the stack from a solid line position to a phantom line position.

As a tag T or TM advances into the nip of the rolls 26 and 42, the tag T or TM is advanced at an acute angle of about 15° with respect to the vertical. FIG. 5 shows the trailing edge or end TE contacted by a tooth 43. In the solid line position of the incoming tag T, the tag T, which has some flexibility, is shown slightly bent as it is pushed upwardly. Movement of the incoming tag T against the last tag T' in the stack S results in the incoming tag T slowing down due to friction therebetween. The incoming tag also causes the next adjacent few tags to remain above the normal even level of the stack S as shown in FIG. 5 due to friction. The teeth 43 assist in straightening out the tag T and moving the tag T to the phantom line position PL in FIG. 5 and to the solid line position in FIG. 6. As the incoming tag T advances, the tamping mechanism makes room for the incoming tag T and helps to settle the tags T and TM against a floor 47 of the hopper H. The roll 26 continues to contact the trailing end of the incoming tag T to a position above the level of the floor 47. Thus, it is assured that all the tags T and TM not only reach the level of the floor 47 but reach a higher level from which they can thereafter descend due to the action of the tamping mechanism 15. The teeth 43 help to push or kick the tags to the proper position in front of the tamping mechanism 15.

The tamping mechanism 15 includes a tamper plate 48 pivotally mounted on a shaft 49 mounted in plates 17 and 18. A tension spring 50 connected to a pin 51 on the plate 18 and to the tamper plate 48 urges the tamper plate 48 counterclockwise (FIG. 4) against an eccentric or cam 52. The cam 52 is secured to a shaft 53 rotatably mounted on the plates 17 and 18. A toothed pulley belt 54 meshes with toothed pulley wheels 55 and 56. The pulley wheel 56 is driven by an electric motor 57 secured to the plate 18. The electric motor 57 causes the cam 52 to rotate to in turn oscillate the tamper plate 48. The tamper plate 48 oscillates to push the stack S slightly to the left in FIG. 4 to make room for the incoming tag T or TM and also to settle the tags at the input end of the stack S in the hopper H. As shown the tag T settles to a level L.

The tamper plate 48 has a vertically extending series of horizontal teeth 58. A frictional stop or arresting device 59 is mounted on the tamper plate 48. The device 59 has a transverse portion 60 disposed at the front of the tamper plate 48 and a pair of flanges 61 which contact the rear of the tamper plate 48. The front of the tamper plate 48 has spaced vertically extending grooves 62. The device 59 has fingers 63 which extend into the grooves 62 to prevent a tag T or TM from being inserted between the tamper plate 48 and the device 59. The tags T and TM move up to and slightly along surface 64 of the device 59. The surface 64 is inclined at an acute angle with respect to the vertical as shown, and exerts resistance against advance of a tag T to whose length the height of the device has been adjusted. The device 59 and the frictional force between the tag T' and the incoming tag T will prevent the tag T from overshooting much beyond the intersection 65 of the tamper plate 48 and the surface 64. However, a longer tag such as a marker tag TM continues to be driven by the rolls 26 and 42 long after the leading edge of the tag TM has passed the intersection 65. The inclined surface 64 guides the somewhat flexible tag TM upwardly and to the left as viewed in FIG. 4.

The position of the device 59 for tags T can be adjusted to accommodate tags T of different heights. With reference to FIG. 2, the device 59 is shown to have two sets of teeth 66 which can engage the teeth 58. The entire device 59 is molded of flexible resilient plastics material. The central portion 67 can be manually flexed in the direction of arrow A so that the teeth 66 lose contact with the teeth 58. The device 59, which makes a frictional fit with the tamper plate 48, can thus be slid manually upwardly or downwardly in accordance with the length of the tags T to be stacked. Release of the central portion 67 causes the teeth 66 to engage teeth 58 corresponding to the selected length of the tags T.

Figure 3:
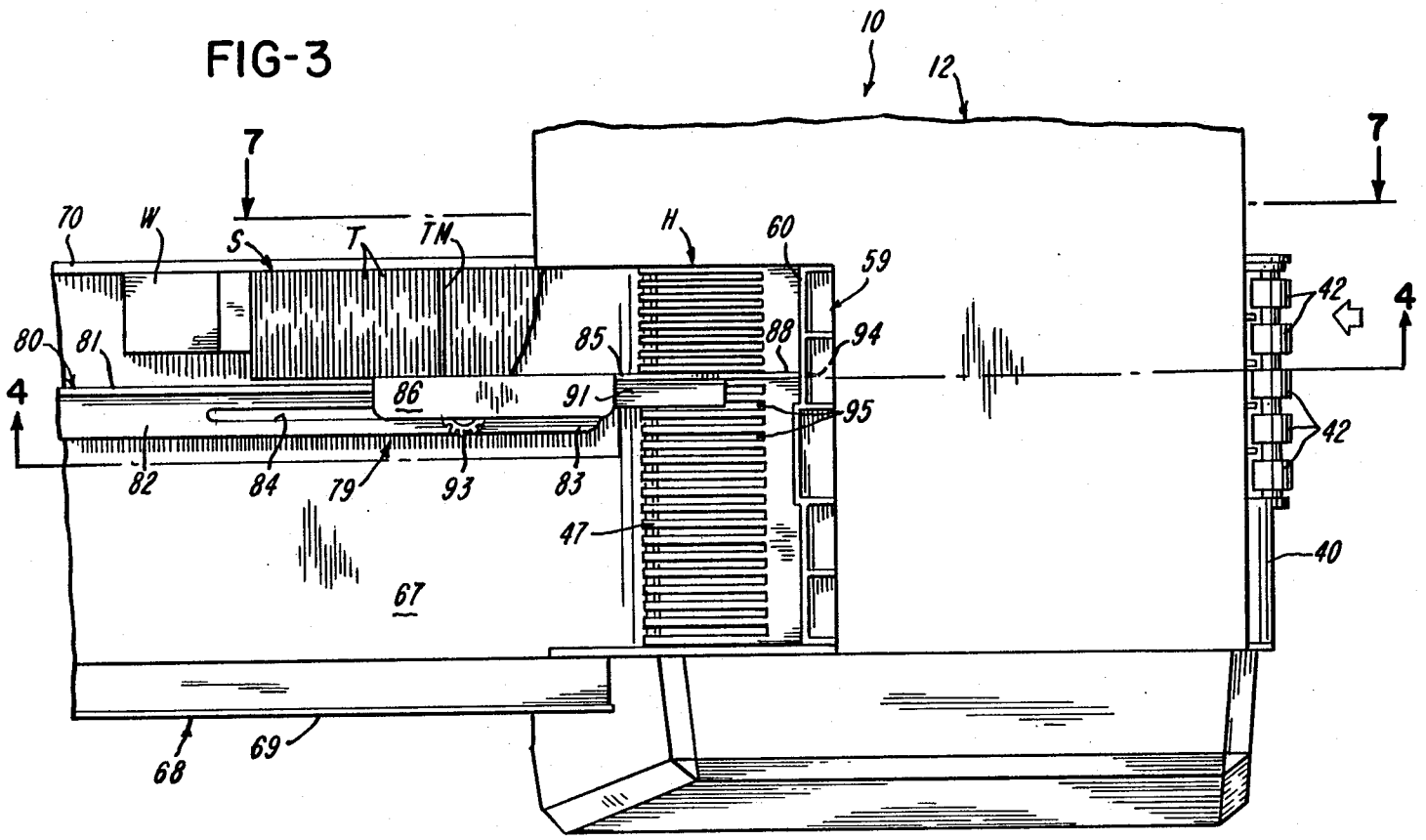
FIG. 3 is a top plan view of a fragment of the tag stacker.
Figure 8:
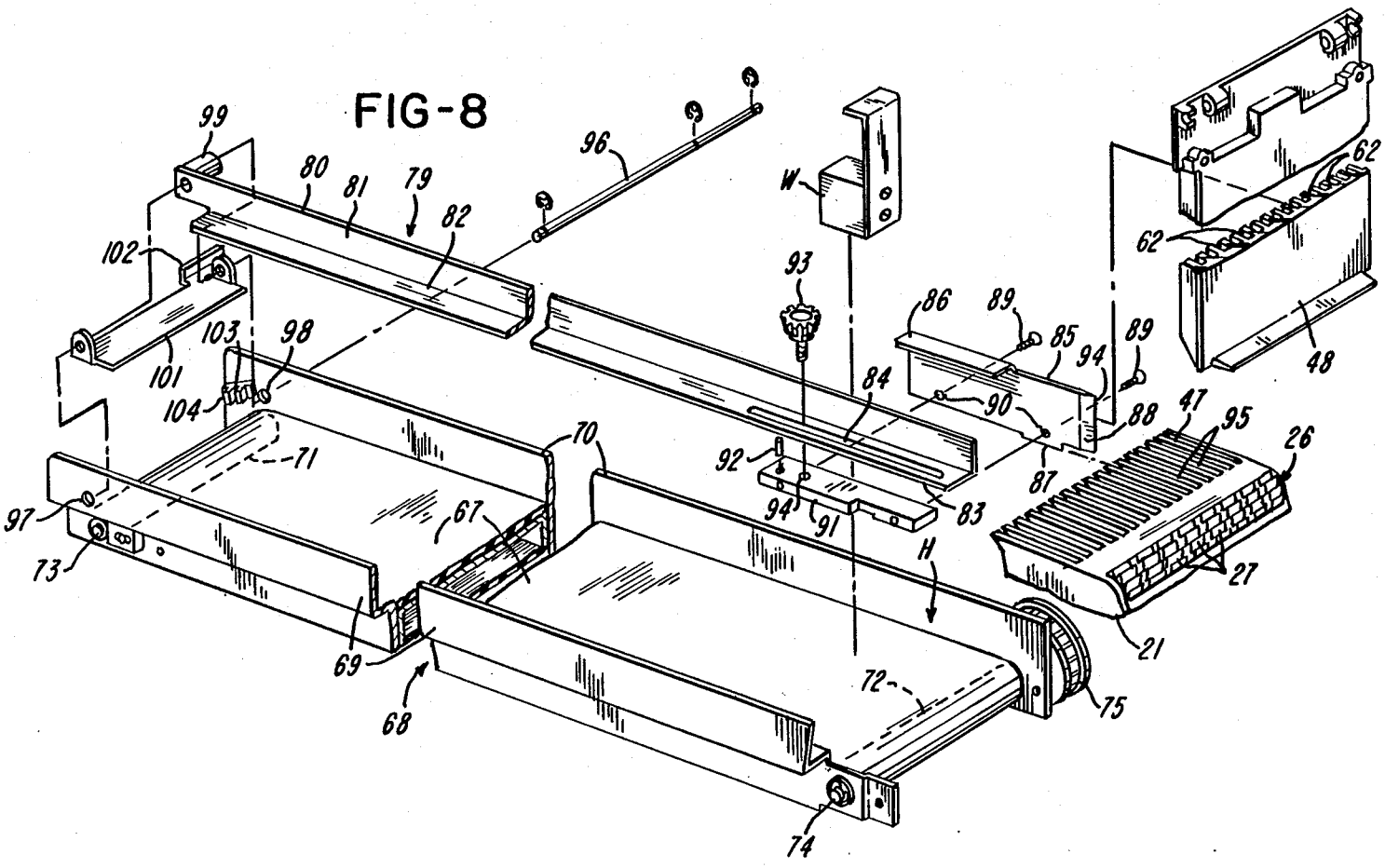
FIG. 8 is an exploded perspective view of portions of an infeed conveyor, a tamping mechanism and an outfeed conveyor, in conjunction with a side guide for the tag stack.

As best shown in FIGS. 3 and 8, the hopper H includes the floor 47 and the conveyor belt 67 the upper surface of which also constitutes part of a stack-supporting floor. The tags T and TM are supported on these floors. The conveyor belt 67 forms part of a conveyor 68 which also includes mounting plates 69 and 70. The belt 67 passes about pulley rolls 71 and 72 mounted on respective shafts 73 and 74. The shaft 74 mounts a toothed pulley wheel 75. A pulley belt 76 meshes with a toothed pulley wheel 75 and a toothed pulley wheel 77. The pulley wheel 77 is driven by an electric motor 78 which is preferably a stepping motor with a built-in speed reducer. When the stack S builds the conveyor belt 67 is intermittently advanced by the motor 78.

One side of the stack S is guided by the plate 70 which is fixed and the other side of the stack S is guided by a side guide generally indicated at 79. The side guide 79 includes a longitudinally extending angle-shaped member 80 having a vertical wall 81 and a horizontal base 82. End portion 83 of the member 80 has a longitudinally extending slot 84. An adjustable vertically extending guide member 85 has a flange 86, a depending projection 87 and a tapered marginal end portion 88. Screws 89 pass through holes 90 in the guide member 85 and are threadably received in a bracket 91. The bracket 91 has an upstanding guide pin 92 received in the slot 84. A thumb screw 93 passes through the slot 84 and is threadably received in a threaded hole 94 in the bracket 91. The guide member 85 can be adjusted longitudinally or telescoped with respect to the member 80 by loosening the thumb screw 93. The marginal end 88 of the guide member 85 extends into one of the grooves 62 corresponding to the width of the tags T being stacked. The marginal end 88 is long enough and the grooves 62 are deep enough so that in spite of the oscillations of the tamper plate 48, no tag T or TM can fit between terminal end 94 of the member 85 and the tamper plate 48. The projection 87 fits into a groove 95 in the floor 47 corresponding to the width of the tags T and TM being stacked. The grooves 62 and 95 are aligned. No tag T or TM can slip between the guide member 85 and the upper surface of the floor 47. As shown, the floor 47 is part of the mounting member 21.

A shaft 96 received in holes 97 and 98 in plates 69 and 70 supports the far end of the side guide 79. The wall 81 has a tubular projection 99 which receives the shaft 96. In order to adjust the side guide 79 transversely, the thumb screw 93 is loosened and the guide member 85 is slid to a position wherein its terminal end 94 is out of a groove 62. The guide 79 can now be adjusted laterally or transversely to a selected position, and when in that position, the guide member 85 is slid so that its terminal end 94 is in the groove 62 to such an extent that the marginal end 88 will be in the groove 62 irrespective of whether the cam 52 is at its high point (FIG. 6) or its low point (FIG. 5). It should be noted that the end 94 should not bottom in the groove 62 when the cam 52 is at its high point.

A conveyor-full sensor 100 is pivotally mounted on the shaft 96. When a weight W contacts edge 101, the sensor 100 pivots and vane 102 enters a gap 103 in a switch 104 to disable the electric motors 31, 57 and 78.

An optical sensor 105 (FIG. 4) senses the passage of tags T and TM through the pathway 45. The sensor 105 is used to control the intermittent operation of the motor 78 and hence the intermittent advance of the conveyor 68.

Other embodiments and modifications of the invention will suggest themselves to those skilled in the art, and all such of these as come within the spirit of this invention are included within its scope as best defined by the appended claims.

We claim:

1. A tag stacker, comprising: a hopper, means for feeding tags one-by-one to the hopper, means including a driven kicker roll having a plurality of teeth for kicking tags one-by-one into a generally vertical position in a stack, means for tamping the stack by tamping the last tag kicked into the stack by the kicker roll, and means for feeding the stack in a direction away from the tamping means.

2. A tag stacker as defined in claim 1, wherein the tag feeding means includes a plurality of feed rolls disposed along a curved path.

3. A tag stacker as defined in claim 1, wherein the tag feeding means includes a plurality of feed rolls disposed along a curved path, means including an electric motor for driving the feed rolls, and wherein the tamping means includes an electric motor.

4. A tag stacker as defined in claim 1, wherein the hopper includes a conveyor for advancing the stack away from the tamping means when the size of the stack has increased, means for continuously driving the feeding means and the tamping means, and means including an electic motor separate from the driving means for intermittently advancing the stack.

5. A tag stacker as defined in claim 4, wherein the driving means includes an electric motor for driving the feed rolls, and wherein the tamping means includes an electric motor.

6. A tag stacker as defined in claim 1, wherein the tamping means includes a pivotally mounted plate for contacting an endmost tag in the stack, and means including an electric motor for oscillating the plate.

7. A tag stacker as defined in claim 6, wherein the oscillating means includes a cam driven by the electric motor.

8. A tag stacker as defined in claim 1, wherein the tag feeding means includes a plurality of spaced driven rolls, a mounting member having idler rolls cooperable with the driven rolls, and means for pivotally mounting the mounting member between an operating position and an open position.

9. A tag stacker as defined in claim 1, wherein the feeding means includes a plurality of spaced rolls, an electric motor, and gearing drivingly connecting the electric motor and the rolls.

10. Method of stacking tags, comprising the steps of: providing a side guide for guiding a side of a longitudinal extending stack of tags, tamping the stack as each additional tag is being added to the stack, wherein the tamping step uses an oscillating tamper plate having transversely spaced recesses, positioning the guide to extend in a selected recess in the tamper plate corresponding to the width of the tag stack, and wherein the guide is maintained in the selected recess irrespective of the oscillation of the tamper plate to prevent a tag from fitting between the tamper plate and the side guide.

11. A tag stacker, comprising: a hopper, means for feeding tags one-by-one to the hopper, the hopper including a side guide for guiding a side of a longitudinally extending stack of tags, means for tamping the stack as each additional tag is being added to the stack, the tamping means including an oscillating tamper plate having transversely spaced recesses, the side guide being positioned to extend into a selected recess in the tamper plate corresponding to the width of the tag stack so that the side guide is maintained in the selected recess irrespective of the oscillation of the tamper plate to prevent a tag from fitting between the tamper plate and the side guide.

12. A tag stacker, comprising: a hopper, means for moving tags one-by-one into the end of a stack of tags in the hopper, means for tamping the stack by tamping the last tag moved into the stack, the tamping means including a plate adjacent the last tag in the stack, means on the plate for arresting the movement of the last tag, means for adjusting the position of the arresting means for tags of different lengths, and wherein the arresting means includes a guide having an inclined surface contacted by the leading edge of the last tag but enabling a longer tag to continue beyond the edge of the stack.

13. A tag stacker, comprising: a hopper, means for moving tags one-by-one into the end of a stack of tags in the hopper, means for tamping the stack by tamping the last tag moved into the stack, the tamping means including a plate adjacent the last tag in the stack, means on the plate for arresting the movement of the last tag, means for adjusting the position of the arresting means for tags of different lengths, means for oscillating the plate, and means on the plate for stopping tags of first length so that the leading edge of the tags of the first length are generally aligned in the stack but enabling tags of a second length longer than the first length to extend beyond the generally aligned leading edges of the first tags.

14. A tag stacker as defined in claim 13, including means for adjusting the position of the stopping means.

15. A tag stacker as defined in claim 13, wherein the stopping means includes an adjustable member mounted for movement on and relative to the plate, wherein the plate includes a plurality of teeth and the adjustable member includes at least one tooth member cooperable with a said tooth on the plate.

16. A tag stacker as defined in claim 15, wherein the adjustable member includes a flexible resilient portion, the tooth member being disposed on the flexible resilient portion, wherein the flexible resilient portion is manually deflectable to enable the adjustable member to be repositioned so that the tooth member cooperates with a different tooth on the plate.

17. A tag stacker, comprising: a hopper, means for arranging tags in a stack in the hopper, a longitudinally extending conveyor for supporting the tags at their end edges, a side guide for guiding the side of the stack, means for adjusting the side guide transversely of the conveyor to accommodate tags of different widths, wherein the arranging means includes means for tamping the stack, wherein the tamping means includes an oscillating plate, transversely spaced recesses on the plate, the side guide extending into one of the recesses on the plate corresponding to the selected position of the side guide, the side guide extending into the recesses to a sufficient extent so that a tag is prevented from fitting between the plate and the side guide.

18. A tag stacker as defined in claim 17, wherein the side guide includes relatively movable members which enable the side guide to be removed from any selected recesses and repositioned in any other recess.

* * * * *